US005156487A

United States Patent [19]

Haid

[11] Patent Number: 5,156,487

[45] Date of Patent: Oct. 20, 1992

[54] ADJUSTABLE SCREED AND ADJUSTMENT MEANS THEREFOR

[76] Inventor: Ray F. Haid, 125 Main Street North, St. Clements, Ontario, Canada, N0B 2M0

[21] Appl. No.: 626,452

[22] Filed: Dec. 12, 1990

[30] Foreign Application Priority Data

Sep. 20, 1990 [GB] United Kingdom ..... 9020564

[51] Int. Cl.[5] ..... E01C 19/22; E01C 11/24

[52] U.S. Cl. ..... 404/72; 404/119

[58] Field of Search ..... 404/72, 84-85, 404/118-120

[56] References Cited

U.S. PATENT DOCUMENTS 4,395,156 7/1983 Sprague ..... 404/118 X
4,655,633 4/1987 Somero et al. ..... 404/118 X
4,702,642 10/1987 Musil ..... 404/118
4,854,769 8/1989 Fukukawa et al. ..... 404/118 X
4,930,935 6/1990 Quenzi et al. ..... 404/118
4,978,246 2/1990 Quenzi et al. ..... 404/118 X

*Primary Examiner*—Ramon S. Britts
*Assistant Examiner*—Nancy P. Connolly
*Attorney, Agent, or Firm*—Daryl W. Schnurr

[57] ABSTRACT

The invention is drawn to a self-propelled power screed for smoothing freshly poured concrete. The screed is fully supported upon two or more vertically adjustable ski-shaped bases that manipulate the height of the screed relative to the surface. Each of the supports is powered by its own motor and may be adjusted independently in order to achieve a desired operating slope. The supports are situated within the outer limits of the screed body.

19 Claims, 2 Drawing Sheets

ADJUSTABLE SCREED AND ADJUSTMENT MEANS THEREFOR

BACKGROUND OF THE INVENTION

1. Field of the Invention

This invention relates to a power screed for smoothing concrete and a method of operating said screed where the screed has adjustable vertical support means to account for uneveness in a supporting surface on which the concrete is being laid in order t control the level of the screed as desired.

2. Description of the Prior Art

It is known to have power screeds that are used during the laying of concrete, particularly in the laying of concrete floors, roadways, ramps, walkways and the like. The screeds have an elongated shape two sides, a front and a rear and are designed to be placed transversely relative to a width of concrete that is being laid. The screeds are self-propelled and vibrate in a forward direction along the width of concrete to smooth and level the concrete. Concrete is poured in front of the screed and roughly levelled using rakes or other suitable means before being contacted by the screed. As the screed passes over the roughly levelled concrete, it adjusts the level of the concrete to a predetermined height and smooths it so that concrete at a rear of the screed is smooth. With many of the known screeds, the level of the concrete is determined by bulkheads or forms that are constructed along either side of an area where a width of concrete is to be laid. One side of the screed rests on one bulkhead and the other side of the screed rests on the other bulkhead. As the concrete is poured, the screed moves forward to smooth out the concrete so that an upper surface of the concrete is at the same level as an upper surface of the bulkheads and a lower surface of the screed. When laying a concrete floor, for example, the bulkheads must be installed in several parallel rows, each row having a width that is smaller than the width of the screed. The screed is then placed onto the bulkheads with one side of the screed resting on one bulkhead and the other side of the screed resting on the remaining bulkhead. When concrete floors are poured in this manner, the concrete is poured in alternate rows. The concrete in those rows is allowed to set and then the bulkheads are removed and the concrete is poured in the remaining rows using the rows that have already set to support the screed in place of the bulkheads. The installation of the bulkheads is a time consuming and expensive process as the surface on which the concrete is to be laid is uneven. Also, the bulkhead system does not provide a sufficient degree of versatility. An upper surface of the bulkheads must be made to correspond to an upper surface of the concrete to be poured. When it is desired to vary a level of the concrete, for example, in the area of a drain, difficulties can be encountered. If the level of the screed is to be lowered the bulkheads must be sloped to the desired lower level. Another known power screed is suspended by a boom from a self-propelled motor vehicle. The level of this screed is controlled by lasers but the screed suffers from disadvantages in that: it is extremely expensive; it can be difficult to manoeuver in restricted areas because of its large size; it can only smooth concrete in an area of approximately twelve feet in width by twenty feet in length without stopping to relocate the motor vehicle; the screed itself must have a relatively narrow width (e.g. twelve feet) to keep the size of the entire machine within reason; or, it cannot be added to an existing screed.

SUMMARY OF THE INVENTION

It is an object of the present invention to provide a screed which is self-supported and can be automatically or manually adjusted to any reasonable level. It is a further object of the present invention to provide means for supporting and adjusting a level of a screed.

A self-supported power screed for smoothing freshly poured concrete on a supporting surface has self-propulsion means to move the screed forward and vibration means to smooth said concrete as the screed moves forward. The screed has two sides, with adjustable vertical support means affixed to said screed between the two sides. The support means supports the entire screed and is extendable and retractable, with power means to adjust said support means. Each of said support means extends between said supporting surface and a remainder of said screed to hold a lower edge of said screed above said supporting surface. There are control means connected to said power means to adjust the two support means independently of one another by extending or retracting said support means. A method of levelling freshly poured concrete on a supporting surface uses a power screed having two sides with adjustable support means affixed to said screed near each side thereof. The support means extends between a lower edge of said screed and said supporting surface. The screed has self-propulsion means to move the screed forward and vibration means to smooth said concrete as said screed moves forward. The support means is extendable and retractable with power means to adjust said support means and control means connected to said power means to adjust the two support means independently of one another by extending or retracting said support means.

A method of levelling freshly poured concrete on a supporting surface uses a power screed having two sides with adjustable support means affixed to said screed near each side thereof. Support means extends between a lower edge of said screed and said supporting surface. The screed has self-propulsion means to move the screed forward and vibration means to smooth said concrete as said screed moves forward. The support means is extendable and retractable with power means to adjust said support means. There are control means connected to the power means to adjust the two support means independently of one another by extending or retracting said support means. The method includes activating the control means to adjust each support means so that the lower edge of the screed is at a predetermined level above the supporting surface, activating the selfpropulsion means to move the screed forward while pouring the concrete in front of the screed, activating the power means for each support means, activating the control means for each support means of said screed, adjusting the support means upward or downward to maintain a lower edge of the screed at a desired level regardless of inconsistencies in the level of the supporting surface, moving at least one support means through the freshly poured concrete, thereby leaving a track, manually smoothing the track and continuing to operate the screed and to adjust the support means until concrete of a desired length has been laid.

BRIEF DESCRIPTION OF THE DRAWINGS

In drawings which illustrate a preferred embodiment of the invention.

DESCRIPTION OF A PREFERRED EMBODIMENT

Figure 1:
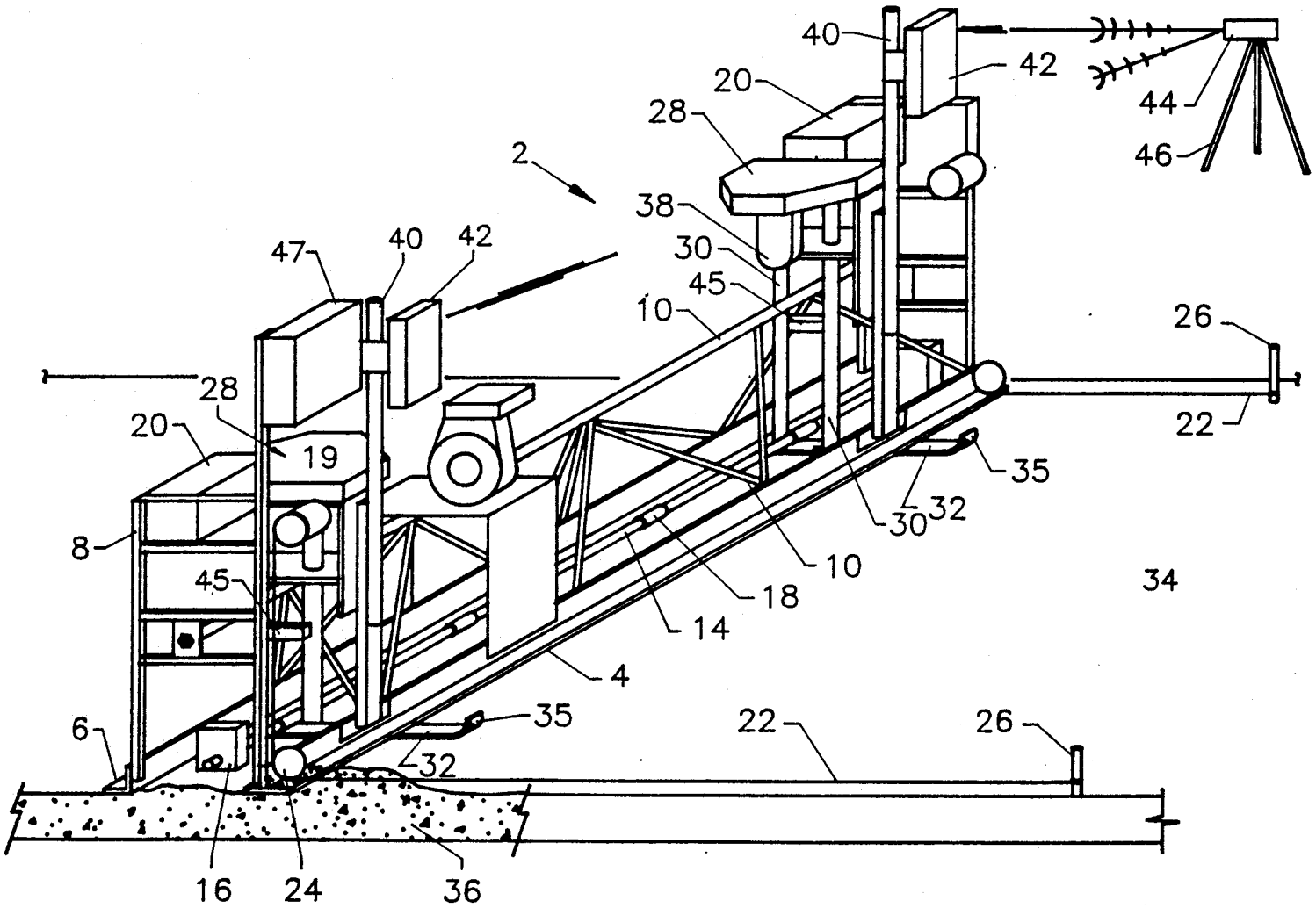
FIG. 1 is a perspective view of a self-supporting screed in operation.

Referring to FIG. 1 in greater detail, a screed 2 has a front edge 4, a rear 6 and two sides 8. The front (or lower edge) 4, rear 6 and sides 8 are held in a fixed relationship to one another by a frame 10. A gasoline powered engine 12 is mounted on the frame and powers the hydraulic motors. A vibrating rod 14 extends along a base of the screed 2 between the sides 8. Each end of the rod 14 is mounted in a bearing 16. The rod 14 contains eccentric weights 18, which cause the rod to vibrate as it is rotated by a belt (not shown) connected to the engine 12. The vibration of the rod 14 causes the entire screed to vibrate.

At either side 8 of the screed, there is located a winch 19 which is connected to a hydraulic motor 20. The winch 19 can wind up a cable 22. The cable 22 is guided by a pulley 24 at the base of the screed 2 and extends forward of the screed 2 by an appropriate distance to an anchor 26. The anchor 26 can simply be a stake that has been driven into the surface on which the concrete is to be poured. The speed of the winches 19 on either side 8 of the screed 2 can be adjusted independently to wind up the cable 22 so that one side of the screed can be moved forward at a faster rate than the other side. This can be advantageous where the strip or row of concrete is to be curved. When concrete is being poured for a roadway and the roadway is curved, the screed can be made to follow the curve. Usually, the speed of the winch on each side of the screed will be indentical so that the screed advances at the same rate on each side. The hydraulic motors 20 are powered by belts (not shown) which are rotated by pulleys (not shown) on the vibration rod 14. The screed thus far described is conventional.

The screed 2 contains adjustable support means 28 near each side 8. The adjustable support means are mirror images of one another. Each support means 28 contains two screw jacks 30 that are mounted on a ski 32. Each ski 32 rests on a supporting surface 34 on which concrete 36 is to be poured. Each ski 32 has an upwardly extending tip 35 on a forward edge thereof so that the ski does not become embedded in the supporting surface 34. The tips may cause the skiis to ride up onto some of the fresh concrete (depending on the density of the concrete). The screw jacks can be retracted or extended by a hydraulic motor 38 located on each support means 28. When the screw jacks for one support means are extended, the screed 2 is raised relative to the ski 32. Similarly, when the screw jacks 30 are retracted, the screed is lowered relative to the ski 32. Preferably, the support means 28 are designed so that a level of the lower edge 4 above the supporting surface 34 can range from a minimum of one inch to a maximum of fourteen and a half inches. While support means could be designed beyond this range, concrete is generally not poured in a thickness of less than one inch or greater than a thickness of fourteen and a half inches.

Each support means 28 has a mast 40 extending upwardly therefrom, the mast containing a receiver 42 which is adjustable along the length of the mast 40. The receiver can receive laser signals from an external laser source 44. The laser 44 is mounted on a tripod 46 or the like and is located at a remote location relative to the screed 2. The receivers 42 are connected to a control panel 47 which contains an automatic mode and a manual mode. When the control panel 47 is in an automatic mode and the laser is activated and properly set up, the laser will activate two solenoid valves 45 (one for each support means), which in turn will activate the hydraulic motors 38 to extend or retract the screw jacks 30 as necessary in order to maintain the screed 2 at a desired level or levels.

For example, where it is desired to level concrete so that its upper surface is horizontal, the laser will cause the screw jacks to be retracted or extended to account for the unevenness of the supporting surface 34 so that the front edge 4 and rear 6 of the screed 2 as well as each side 8 are maintained at a constant level (i.e. in the same horizontal plane). When the level is controlled by the external laser, the support means will automatically compensate for any depressions or ridges in the supporting surface, as well as whether the skiis are riding on some of the concrete or riding directly on the supporting surface. The control panel 47 can control each support means 28 independently of one another and the laser 44 can be programmed to vary the level of the screed 2 on each side equally or to vary the level of the screed on one side relative to the other side. For example, the laser could be programmed to have the concrete poured on a slope. As another example, where a drain is located, the laser could be programmed to smoothly lower one side of the screed to allow for the drain and subsequently smoothly raise that side to the level of the other side. As an alternative, the control panel 47 could be switched to the manual mode for one side of the screed and the level of that one side could be controlled manually to lower the one side in the area of a drain. As a further example, both sides of the screed could be controlled manually to level the concrete as desired without using the laser. When the skiis ride up on some of the concrete this change in level is automatically taken into account by the external laser controlling the level of the screed in one plane or it can be taken into account manually, when the manual control is used.

When the concrete is levelled using the selfsupporting screed 2, a track is left in the otherwise smooth concrete directly behind each of the skis. During the levelling process, additional concrete can be hand-shovelled into this area and the area can then be made smooth manually. In this manner, concrete can be poured in one direction continuously, as desired. No bulkheads are required and the level of the screed can be controlled by a laser or controlled manually or by a combination thereof.

When the screed is used to pour a concrete floor, strips of concrete can be poured in rows that are immediately adjacent to one another without waiting for the previously poured row to cure or harden. It is no longer necessary to pour the concrete in alternate rows and the floor can be completed in one continuous pour without the use of bulkheads. When a floor is being poured, it is preferred to have only one ski in the concrete and to keep the row narrow enough so that the other ski is not in the concrete. When an adjacent row is being poured the screed can overlap slightly (for example, six inches to a foot) with the row pour immediately previously.

Figure 2:
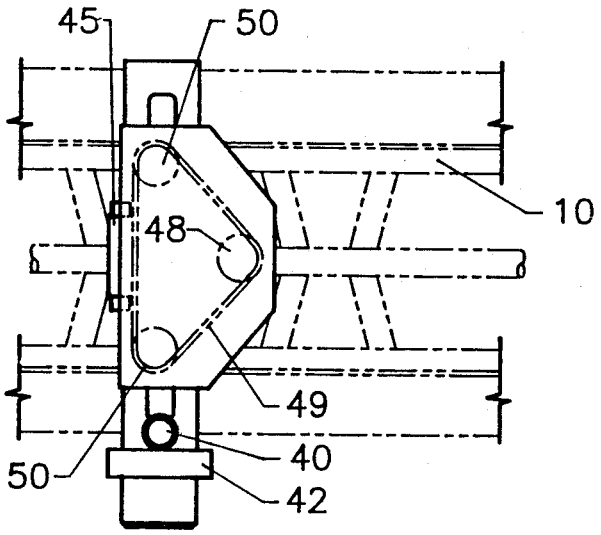
FIG. 2 is a top view of one support means connected to a screed.
Figure 3:
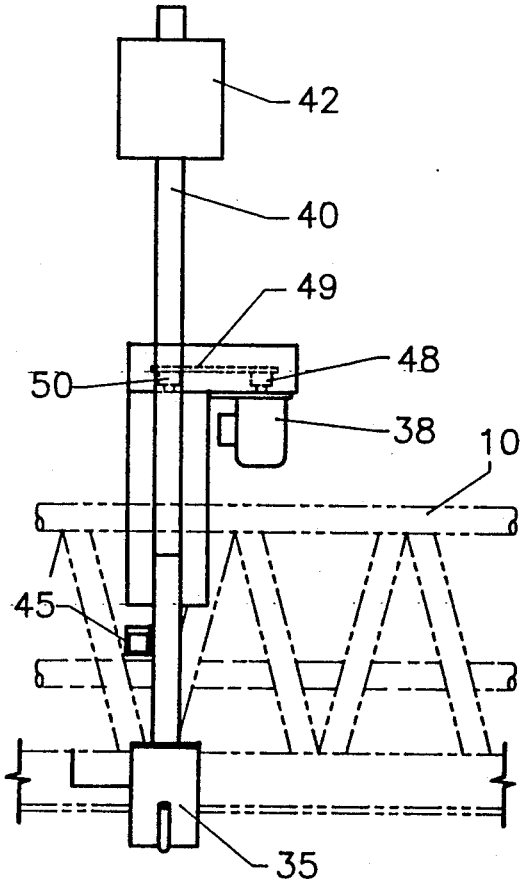
FIG. 3 is a front view of said support means and partial screed.
Figure 4:
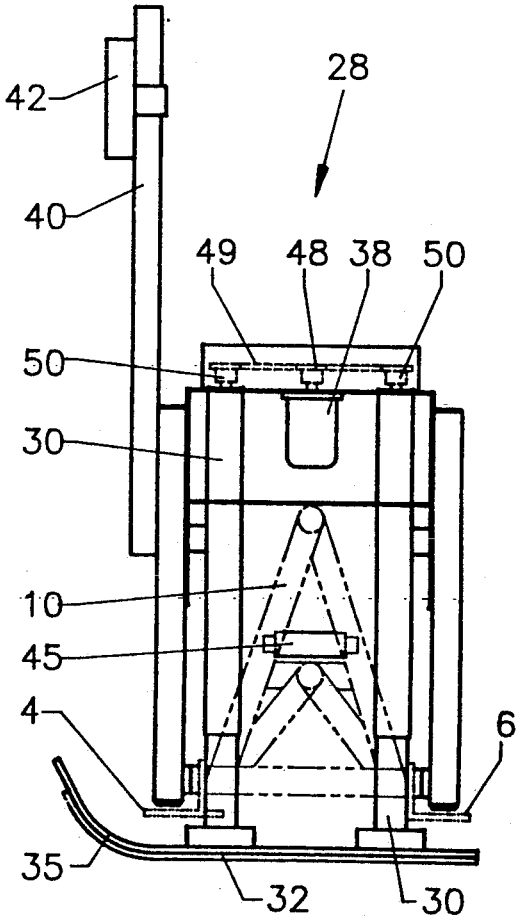
FIG. 4 is a side view of said support means and said screed.

In FIGS. 2, 3 and 4 it can be seen that the hydraulic motor 38 of each adjustable support means 28 has a pulley 48 thereon, which is connected by means of a linked chain 49 to similar pulleys 50 on each of the screw jacks 30. The chain 49 ensures that the screw jacks for each support means 28 are retracted or extended at the same rate. The conventional parts of the screed 2 in FIGS. 2, 3 and 4 are shown by dotted lines. For ease of illustration hydraulic fluid reservoirs and hydraulic fluid connecting lines have been omitted from the drawings. In FIG. 1, concrete is shown at one side 8 of the screed 2. In operation, the concrete would usually extend across the entire front edge 4 of the screed at a height higher than said front edge.

The control means is preferably set up in such a manner that the level of the screed 2 can be varied in increments of one-thirty-second of an inch. When a laser is used to control the level of the screed, the level of the screed is first set manually to the desired level on each side by activating the control panel. Next, the receivers are slidably adjusted on each mast 40 so that the level of the receiver corresponds to the level of the laser 44. Each control panel is then fixed in position on the mast at this level. As the screed is moved forward, the laser will then maintain the screed at the desired level. When a drain is encountered and it is desired to lower one side of the screed, it is preferred to switch the control panel from the automatic mode to the manual mode. One side of the screed can then be lowered smoothly to the desired level of the drain. After the desired level has been attained, the same side of the screed can be raised smoothly to its former level. When the former level is attained, the control panel can be switched from manual to automatic so that the laser can control the level again. The use of the automatic mode in combination with the manual mode in this manner results in an extremely efficient method of laying concrete.

As another example, when laying concrete for a roadway between two curbs, the desired level of the surface of the concrete after it is poured could be marked with a line along the inside of each curb. A screed could be chosen having a width slightly smaller than the width of the roadway. The level of the screed could be controlled automatically by an external laser in combination with manual adjustments for drains and the like. Alternatively, the level of the screed could be controlled solely by manual adjustments in the vertical support means through the control panel. The concrete could be poured and the screed adjusted slightly upward or downward to maintain a finished surface of the concrete at the same height as the lines on the inside of each of the curbs. While adjustments of one-thirty-second of an inch are made in the level of a screed, these adjustments will be unnoticeable in the finished concrete. When a roadway slopes upward or downward, the manual method of adjustment could be more efficient than the automatic method. Further, if the size of the screed is chosen properly, there will be sufficient room on either side of the screed to form a gutter for drainage purposes. For example, a two foot width on either side of the screed, located between the screed and each curb could be formed with a slight depression but runs parallel to each curb to provide for drainage.

As another example, when a screed of the present invention is used within a building and there are vertical supports extending between the floor and the roof of the building, a screed of appropriate size can easily be chosen to ensure that the screed will be wide enough to lay the concrete floor efficiently, yet narrow enough to fit easily between the vertical supports.

An advantage of the support means of the present invention is that a screed can be constructed to contain the support means or, alternatively, the support means can be added to an existing screed. There are various kinds of screeds available on the market that are different from the screed shown in the drawings. It will be readily apparent to those skilled in the art that the adjustable support means can be advantageously affixed to virtually any screed. There is one hydraulic motor for each support means so that each support means can be extended or retracted, independently, as desired. In addition a self-supported screed of virtually any reasonable width can be utilized. For example, a screed having a width of sixty feet could be utilized in accordance with the present invention. This screed could be used to pour a seamless strip of concrete having a width of sixty feet. Usually, the width of the screed will range from twelve feet to thirty feet with twenty feet being the most common. The length of the pour is limitless. When the cables 22 have been almost completely wound onto the winches, the stakes can be moved further ahead and the cables can be extended to the new location of the stakes. The winches can then be reactivated to pull the screed towards the stakes. For particular projects, it may be desirable to construct a screed having a width exceeding sixty feet. While the screed of the present application has two skiis, for particular applications, more than two skiis and two support means may be desirable. For example, with wide screeds, it may be desirable to have one or more additional support means located between the support means near the two sides. A screed of the present invention provides a method of laying concrete that is considerably more efficient than previous methods and less expensive. By utilizing the screed of the present invention, an amount of concrete can be laid with less manpower than with previous unsupported screeds. Variations, within the scope of the claims, will be readily apparent to those skilled in the art.

In one variation, hydraulic cylinders could be used in place of the screw jacks which would result in the elimination of the chain 49 and the pulleys 48, 49, 50.

What I claim as my invention is:

1. A self-supported power screed for smoothing freshing poured concrete on a supporting surface, said screed comprising self-propulsion means to move the screed forward and vibration means to smooth said concrete as the screed moves forward, said screed having two sides, at least two vertically with adjustable support means affixed to said screed between the two sides, said support means supporting the entire screed and being extendable and retractable, with power means to adjust said support means, each of said support means extending between said supporting surface and a remainder of said screed to hold a lower edge of said screed above said supporting surface, with control means connected to said power means to adjust the two support means independently of one another by extending or retracting said support means.

2. A screed as claimed in claim 1 wherein each adjustable support means has two jacks mounted on a common base, the jacks being vertically adjustable by a power source for each of the support means.

3. A screed as claimed in claim 2 wherein the jacks are screw jacks and the power source for each support means is a hydraulic motor, the base having a shape of a ski with a forward edge being turned upward to form a tip, said jacks being mounted one behind the other on said base, each ski being long enough to support the screed in an upright position.

4. A screed as claimed in claim 3 wherein said control means includes a receiver on each support means, each receiver being adjustable vertically and being capable of receiving a laser signal, each receiver automatically adjusting each support means independently to maintain a lower edge of said screed at a desired predetermined level or levels relative to an external laser source regardless of inconsistencies in a level of the supporting surface.

5. A screed as claimed in claim 4 wherein there are two support means, on support means near each end of said screed, each support means has a vertical mast thereon and the receiver is adjustably mounted on said mast.

6. A screed as claimed in claim 5 wherein the receivers are connected to the control means, a solenoid valve is connected between the control means and each hydraulic motors for each support means, the external laser activating the solenoid valve, which in turn activates the hydraulic motors to extend or retract the support means.

7. A screed as claimed in claim 6 wherein the control means is a control panel having a manual mode and an automatic mode so that the level of each support means can be controlled manually through said control means or automatically, as desired.

8. A screed as claimed in claim 3 wherein the adjustable support means are mirror images of one another.

9. A screed as claimed in claim 7 wherein the lower edge of said screed is adjustable through a range of 1 inch to 14.5 inches above said supporting surface.

10. A screed as claimed in claim 7 wherein each support means can be adjusted manually in increments of one-thirty-second of an inch by appropriately activating said control means.

11. A screed as claimed in claim 7 wherein the control means has a switch thereon to switch from a manual mode to an automatic mode and vice-versa.

12. A screed as claimed in claim 6 wherein, when the screed is used to level concrete, the screed traverses the concrete with at least one of the support means extending into said freshly poured concrete and leaving a track in said freshly poured concrete immediately to the rear of the support means as the screed moves forward.

13. A screed as claimed in claim 3 wherein the two screw jacks of each support means are connected by a linked chain to the hydraulic motor so both of said screw jacks extend or retract at the same rate.

14. A screed as claimed in claim 1 wherein each adjustable support means has two hydraulic cylinders mounted on a common base, the hydraulic cylinders being vertically adjustable by a power source for each of the support means.

15. A method of levelling freshly poured concrete on a supporting surface using a power screed having two sides, with adjustable support means affixed to said screed near each side thereof, said support means extending between a lower edge of said screed and said supporting surface, said screed having self-propulsion means to move the screed forward and vibration means to smooth said concrete as said screed moves forward, said support means being extendable and retractable, with power means to adjust said support means, with control means connected to said power means to adjust the two support means independently of one another by extending or retracting said support means, said control means including a receiver on each support means, each receiver being adjustable vertically and being capable of receiving a laser signal, each receiver automatically adjusting said support means independently to maintain a lower edge of said screed at a desired predetermined level or levels relative to an external laser sourse regardless of inconsistencies in a level of the supporting surface, said control means having an automatic mode and a manual mode so that the level of each support means can be controlled manually through said control means or automatically as desired, said method comprising activating the control means to adjust each support means so that the lower edge of said screed is at a predetermined level above the supporting surface, next adjusting each receiver vertically to a level where it can receive a signal from an external laser source, affixing the position of each receiver at that level, activating the self-propulsion means to move the screed forward while pouring concrete in front of the screed, next activating the power means for each support as well as the receiver, control means, power means and external laser source, ensuring that the control means is in an automatic mode, thereby permitting the screed to move forward while automatically adjusting the support means to account for inconsistencies in the supporting surface while maintaining the lower edge of the screed in the same horizontal plane as said screed moves forward, moving at least one support means through the freshly poured concrete, thereby leaving a track, manually smoothing this track, continuing to operate the screed until a sufficient length of concrete has been laid.

16. A method as claimed in claim 15 wherein the method includes the steps of switching the control means to a manual mode to adjust the screed manually and then switching the control means back to an automatic mode.

17. A method as claimed in claim 16 wherein successive rows of concrete are poured immediately adjacent to one another and, following the completion of a first row, a second row is poured with one side of the screed slightly overlapping the first row and repeating the method until a desired number of rows of a desired length are poured.

18. A method of levelling freshly poured concrete on a supporting surface using a power screed having two sides with adjustable support means affixed to said screed near each side thereof, said support means extending between a lower edge of said screed and said supporting surface, said screed having self-propulsion means to move the screed forward and vibration means to smooth said concrete as said screed moves forward, said support means being extendable and retractable, with power means to adjust said support means, with control means connected to said power means to adjust the two support means independently of one another by extending or retracting said support means, said method comprising activating the control means to adjust each support means so that the lower edge of the screed is at a predetermined level above the supporting surface, activating the self-propulsion means to move the screed forward while pouring concrete in front of the screed, activating the power means for each support means, activating the control means for each support means of the screed, adjusting the support means upward or downward to maintain a lower edge of the screed at a desired level regardless of inconsistencies in the level of supporting surface, moving at least one support means through the freshly poured concrete, thereby leaving a track, manually smoothing the track and continuing to operate the screed and to adjust the support means until concrete of a desired length has been laid.

19. A method as claimed in claim 15 wherein the screed is used to smooth freshly poured concrete in a form of a roadway between two curbs, an interior of said curbs being marked with a line showing the desired level of a surface of the concrete after it has been poured, said method including the steps of adjusting the level of each side of the screed to conform to a level of the line drawn on the curb on that side.

* * * * *